United States Patent [19]

Rankin

[11] Patent Number: 4,825,498

[45] Date of Patent: May 2, 1989

[54] CLEANING PIG WITH SELECTABLE DEBRIS FLUSHING ACTION

[75] Inventor: William J. Rankin, Sapulpa, Okla.

[73] Assignee: TDW Delaware, Inc., Tulsa, Okla.

[21] Appl. No.: 173,284

[22] Filed: Mar. 25, 1988

[51] Int. Cl.[4] ..... B08B 9/04

[52] U.S. Cl. ..... 15/104.061

[58] Field of Search ..... 15/104.061, 104.062, 15/3.5, 3.51; 137/268

[56] References Cited

U.S. PATENT DOCUMENTS

| | | | |
|---|---|---|---|
| 3,605,159 | 9/1971 | Girard | 15/104.061 |
| 4,720,884 | 1/1988 | Ralls | 15/104.061 |

*Primary Examiner*—Edward L. Roberts

*Attorney, Agent, or Firm*—Head & Johnson

[57] ABSTRACT

An improved cleaning pig with selectable debris flushing action for use in a pipeline to be moved through the pipeline by the flow of fluid therethrough, the pig being formed of a cylindrical body of semi-rigid material having shallow depth channels formed in paralleled spirals on the cylindrical surface, the spirals extending less than the full length of the body leaving an uninterrupted portion of the cylindrical surface, and an elongated, brush member positioned in each of the channels, each of the brush members having bristles which extend generally radially outward from the pig body, the width of the brush members being less than the width of the channels providing fluid flow passageways within each of the channels whereby segments of said uninterrupted cylindrical portion of the body may be cut away to establish communication of the flow passageways with both ends of the body to permit fluid to flow past the pig as it is moved through a pipeline to thereby flush debris which has been brushed from the pipeline sidewall forwardly of the pig so that the debris will be carried out of the pipeline, the amount of fluid flow past the pig being selectable by the width and depth of the uninterrupted cylindrical portion which has been cut away.

11 Claims, 2 Drawing Sheets

CLEANING PIG WITH SELECTABLE DEBRIS FLUSHING ACTION

SUMMARY OF THE INVENTION

This disclosure is an improvement to the pipeline pig described in U.S. Pat. No. 4,720,884 issued Jan. 26, 1988 to Gene R. Ralls and entitled: "Cleaning Pig With Debris Flushing Action". As was described in this prior issued patent, pipelines employed for moving fluids, whether liquids or gases, tend to become encrusted on their interior surfaces. This can be caused by oxidation if the pipeline is made of metal, or by the depositions of solids from the fluids passing through the pipeline. As solids adhere to the interior wall of a pipeline the maximum fluid carrying potential of the pipeline is decreased. For this reason it is important to clean the interior of pipelines and for this purpose the use of cleaning pigs is a standard technique.

The typical cleaning pig is a device which fits within the interior of a pipeline and is moved by fluid flow through the line. Apparatus is provided on the pig to engage the interior wall of the pipeline to scrape or brush the interior so as to dislodge solid materials which have adhered to the pipeline interior wall. For information relating to the use of pipeline pigs which have means for brushing or scraping the internal wall of the pipeline as they pass therethrough, reference may be had to the following U.S. Pat. Nos.: 3,204,274; 3,879,790; 3,538,531; 3,605,159; 3,389,417; 3,474,479 and 4,122,575.

The present invention is an improvement in the concept of a cleaning pig made of a cylindrical body having wire brushes thereon. In the present invention the pig cylindrical body is provided with a series of spaced apart shallow depth channels arranged in a spiral format. The channels when the pig is manufactured extend less than the full length of the pig body. Positioned in each of the shallow depth channels is an elongated narrow brush member or strap, which is typically formed of a flexible backing with metal bristles extending upwardly therefrom. The narrow brush members are affixed to the pig body within the channels such as by adhesive bonding. Each brush member is dimensioned to be of a width less than the width of the channel permitting a fluid flow passageway between the channel sidewall and the brush member. In the preferred embodiment, the brush member is centrally positioned within the channel so that a fluid flow passageway is provided to either side of the brush member.

Since the channels extend less than the full length of the pig body, an uninterrupted portion of the cylindrical surface remains. This uninterrupted portion of the cylindrical surface is preferably at the rearward or forward end of the pig body, and most preferably at the rearward end. As long as the uninterrupted portion of the cylindrical surface is intact, no flow paths are established on the surface of the pig. However, a user can establish flow passageways along the full length of the pig body by cutting away segments of the uninterrupted surface. The fluid-carrying capacity of the flow passageways can be controlled by the depth and width of the segments cut away.

With this arrangement spiraled fluid flow passageways are selectably provided on the exterior cylindrical surface of the pig body by the user of the pig. These flow passageways permit fluid to flow past the pig as the pig is moved by the fluid flow through the pipeline.

In other words, the cleaning pig moves through the pipeline at a velocity less than the fluid flow velocity. Debris which is scraped from the pipeline sidewall by the pig tends to be moved by the fluid flow past the pig to thereby move the debris in advance of the cleaning pig. This insures that at least a substantial portion of the debris dislodged from the pipeline interior wall by the cleaning pig is flushed out of the pipeline rather than permitting the dislodged debris to merely accumulate within the pipeline.

By being able to selectably determine the amount of flow restriction in series with the flow passageways formed on the pig body exterior, the user can selectably determine the amount of fluid flow past the pig as it is moved through the pipeline.

A better understanding of the invention will be had by reference to the following description and claims, taken in conjunction with the attached drawings.

DESCRIPTION OF THE PREFERRED EMBODIMENT

Figure 1:
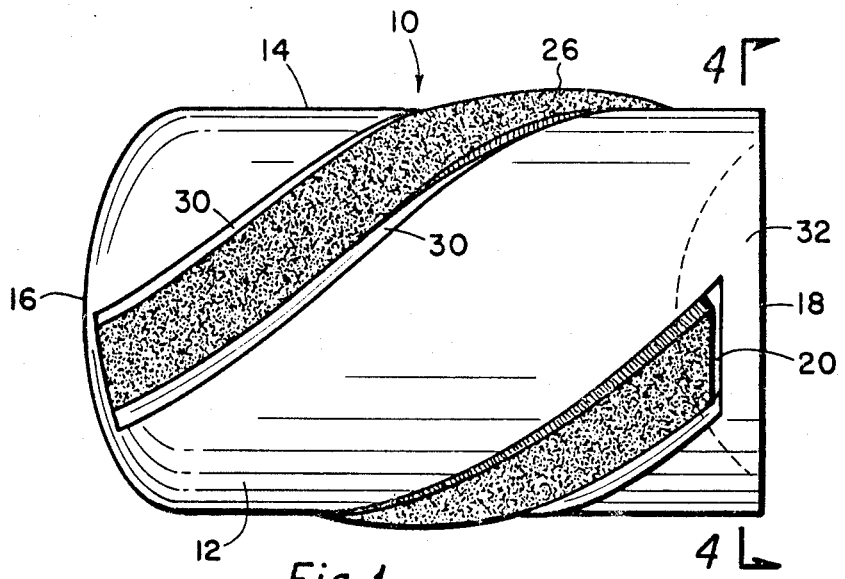
FIG. 1 is an elevational view of an embodiment of the cleaning pig of this invention as it is delivered by the manufacturer to the user. This view shows a portion of the external cylindrical surface of the pig body being uninterrupted, that is, providing a full cylindrical surface.
Figure 2:
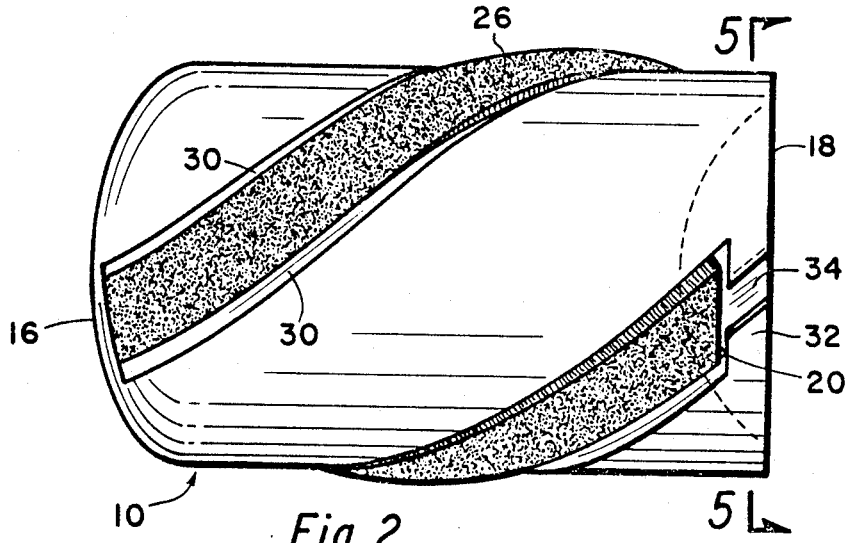
FIG. 2 is an elevational view as in FIG. 1 but showing a segment of the uninterrupted portion of the pig body cut away so as to establish complete flow passageways between the forward and rearward ends of the pig body.
Figure 4:
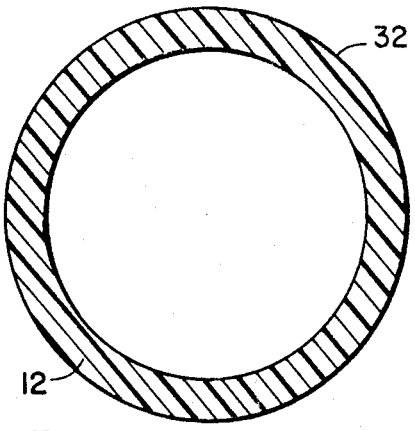
FIG. 4 is a cross-sectional view taken along the line 4—4 of FIG. 1 and showing the form in which the pig is manufactured with the uninterrupted external cylindrical surface portion.

Referring to the drawings and first to FIG. 1, a cleaning pig which includes the principles of this invention is shown in elevational side view. The cleaning pig is generally indicated by the numeral 10 and is formed by a cylindrical body 12 having an external cylindrical surface 14, a forward end 16 and a rearward end 18. The body 12 is preferably formed of a semi-rigid material such as polyurethane foam material. The rearward end 18 is preferably concave to augment the forward force applied by fluid flowing through a pipeline in which the cleaning pig is used. The forward end 16 is preferably convex, or rounded, or pointed so as to facilitate the movement of the pig through the pipeline and past side openings or obstructions in the pipeline.

Figure 7:
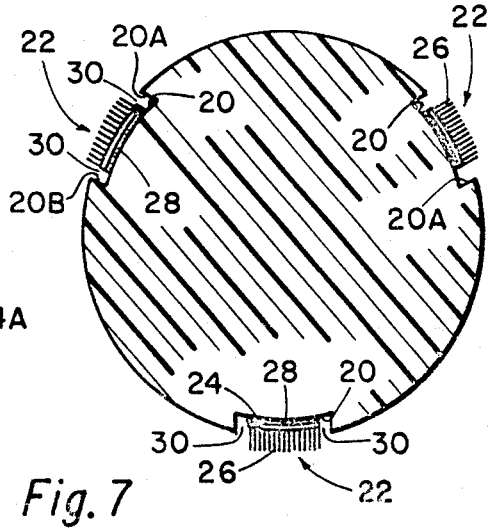
FIG. 7 is a cross-sectional view taken along the line 7—7 of FIG. 3 showing the brush members secured to the external surface of the pig body and the flow passageways to either side of the brush members.

Formed on the cylindrical surface 14 are a plurality of shallow depth channels 20, (see FIG. 7) three such channels being shown in the illustrated embodiment. The channels are spiral in configuration and spaced apart from each other. The channels are spiraled to a degree such that each channel covers a segment of the cylindrical surface which is greater than 360° divided by the number of channels. This means that with three channels employed as illustrated, each of the channels 20 traverses a segment of more than 120° of the cleaning pig exterior cylindrical surface 14.

Positioned within each of the channels 20 is a brush member generally indicated by the numeral 22. Each brush member 22 is preferably formed of a flexible backing 24 having bristles 26 extending generally radially outwardly from the flexible backing. The brush members 22 are preferably in the form of elongated strips of uniform width and the brush members are secured within channels 20 preferably such as by epoxy bonding 28.

The bristles 26 of each brush member are of a height to extend radially outwardly equal to or above the body cylindrical surface 14 so that as the cleaning pig is moved through a pipeline the bristles 26 engage the pipeline around the entire internal circumference thereof to brush away solids which have adhered to the pipeline wall. The channels 20 extend forwardly towards the forward end 16 in the area wherein the external diameter of the pig body has decreased.

One of the problems associated with cleaning the interior of a pipeline by the use of a pig moved by fluid flow is that of flushing the dislodged debris from the interior of the pipeline. For this purpose, in the present arrangement each channel 20 is of a width which is greater than the width of the brush member 22 received in the channel. This provides a spiraled fluid flow passageway 30 between the brush member 22 and the sidewall of the channel. The channel sidewalls are indicated by the numerals 20A and 20B. In the preferred and the illustrated embodiment, the brush members 22 are centrally positioned in the channels between the opposed side walls 20A and 20B thereby providing two fluid flow passageways for each channel. It can be seen that in another embodiment which is not illustrated, the brush members 22 could be positioned contiguous to one of the sidewalls 20A or 20B leaving a single fluid flow passageway in each channel.

The pipeline pig described to this point is that contained in U.S. Pat. No. 4,720,884. The present disclosure is an improvement over that in the prior issued U.S. patent. As seen in FIG. 1, the channels 20 do not extend all the way to the rearward end 18. This leaves an uninterrupted external cylindrical surface portion 32. In the practice of the present invention, the pig 10 is manufactured as shown in FIG. 1, that is, with the uninterrupted cylindrical portion 32. As long as such uninterrupted cylindrical surface portion 32 exists, the fluid passageways 30 are at least substantially blocked—that is, fluid flow through the flow passageways 30 is prevented or at least highly restricted. The embodiment of FIG. 1 would be actually used only in a situation where the user desired no flushing action or only a minimal amount of flushing action. To provide for flushing action, a fluid path must be established for the flow passageways 30 from one end to the other of the pipeline pig. This is achieved in a manner shown in FIGS. 2 through 5. Providing such flushing action is accomplished by the user of the pig of FIG. 1 by cutting communication channels 34, that is, by cutting away segments of the heretofore uninterrupted cylindrical portion 32 to form such communication channels 34. With the provision of the communication channel 34 the flow passageways 30 are permitted to carry fluid flow past the pig. Communication channels 34 are in series with the flow passageway channels 30 so that as the pig moves through the pipeline the velocity of fluid flow will exceed the velocity of the pig as a result of a portion of the pipeline fluid moving past the pig to thereby create a flushing action to cause at least a portion of the debris scraped from the pipeline side wall to be carried forwardly of the pig.

As previously indicated, the pig body 12 is preferably made of semi-rigid material, such as, foam plastic and preferably of polyurethane foam. This material, while tough and resilient, is easily cut with a sharp instrument, such as a knife or saw, so that the communication channels 34 can easy be established either by the manufacturer or by the user in the field.

Figure 3:
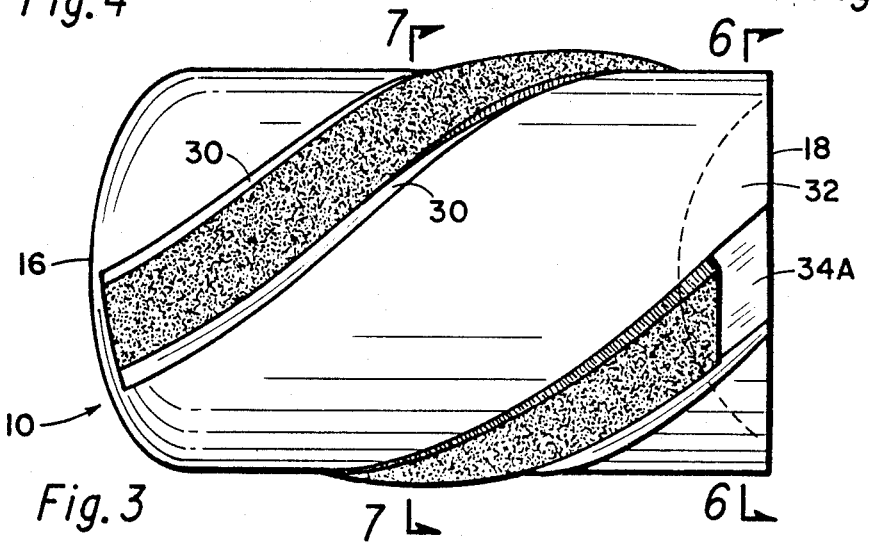
FIG. 3 is an elevational view as in FIGS. 1 and 2 but showing wider segments of the uninterrupted portion being cut away to established high volume flow passageways.
Figure 6:
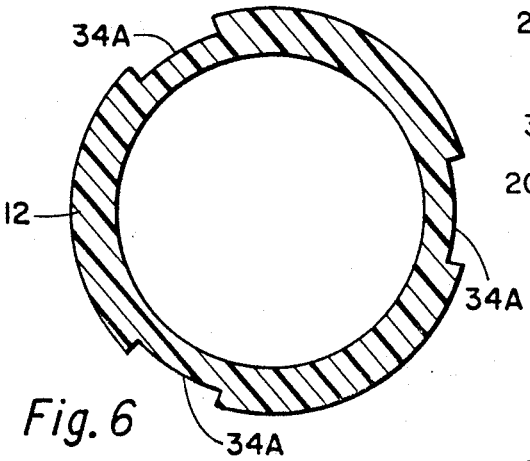
FIG. 6 is a cross-sectional view taken along the line 6—6 of FIG. 7 showing wider grooves cut in the formerly interrupted portion of the pig body external cylindrical surface to establish higher volume flow passageway along the external surface of the pig body.

When greater debris flushing action is required the width of the communication channel 34 may be increased such as shown in FIGS. 3 and 6 where the width of the communication channel has been widened to that of the full width of channels 20. With such wider communication channels 34A the volume of flow of fluid past the pig is greater than with the narrower communication channels 34 of FIG. 2.

Figure 5:
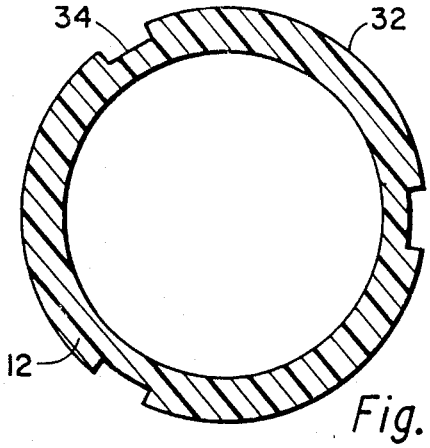
FIG. 5 is a cross-sectional view taken along the line 5—5 of FIG. 2 showing narrow width grooves having been cut in the formerly uninterrupted cylindrical portion of the pig to establish flow passageways with the spiral grooves in the pig body to thereby permit flow of fluid past the pig body to flush debris in advance of the pig body.

FIGS. 5 and 6 show the communication channels 34 and 34A as being of a depth the same as the original channel 20. It can be seen that the volume of fluid flow for providing flushing action can be varied by varying the depth of such communication channels 34 as well as the width.

As the cleaning pig 10 moves through the pipeline by the force of fluid flow, the passageways 30 and communication channels 34 permit a portion of the fluid to flow past the pig as indicated by the arrows in FIG. 1. The fluid flow within passageways 30 tends to move any debris which has been dislodged by bristles 26 forwardly of the pig body as it moves through the pipeline. This flushing action thereby tends to carry the dislodged debris in advance of the cleaning pig and thus carry it out of the pipeline.

The location of flow passageways 30 is important. By providing, in the illustrated arrangement, passageways to either side of each of the brush members 22 any debris which is dislodged by the passage of the brush is quickly encountered by the moving fluid flow stream within the passageways to move it to beyond the forward end 16 of the cleaning pig.

The invention described is an improvement in the cleaning pig with debris flushing action fully described and claimed in U.S. Pat. No. 4,720,884. The present invention adds to such disclosure by providing a means whereby the amount of flushing action is selectable. Particularly, the invention provides a means wherein a pig for cleaning the interior of a pipeline can be manufactured with a later decision made as to the amount of flushing action desired; and, in fact, wherein the decision as to the amount of flushing action can be selected by the user in the field. The invention thus provides an improved cleaning pig for use in pipelines, the pig having improved means of flushing debris out of the pipeline.

The claims and the specification describe the invention and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A cleaning pig for use in a pipeline, comprising:

a cylindrical pig body formed of semi-rigid material, the pig body being dimensioned to be slideably moved by the flow of fluid through a pipeline, the pig body having a forward end and a rearward end;

a plurality of spaced apart shallow depth channels formed in said pig body cylindrical surface, each channel extending from adjacent said forward end of said pig body to adjacent said rearward end but less than the full length of the pig body leaving a severable cylindrical portion of said exterior surface of said pig body; and a brush means positioned in each of said channels arranged to provide at least one fluid flow passageway within each of said channels.

2. A cleaning pig according to claim 1 wherein said cylindrical portion of said exterior surface of said pig body is contiguous to said rearward end thereof.

3. A cleaning pig according to claim 1 wherein each of said brush means is in the form of an elongated narrow member, each brush member having bristles which extend generally radially outwardly from said pig body and to a diameter at least that of said pig body cylindrical surface, the width of each of said brush members being less than the width of said channels providing said at least one fluid flow passageway within each of said channels.

4. A cleaning pig according to claim 3 wherein each said brush member is centrally positioned in each of said channels to provide two flow passageways in a said channel, one to either side of said brush member.

5. A cleaning pig according to claim 3 wherein said brush members are formed of strips of flexible backing having upstanding wire bristles extending therefrom, the flexible backing being of width less than the width of said channels.

6. A cleaning pig according to claim 5 wherein strips of flexible backing are secured to said pig body within said channels by adhesive bonding.

7. A cleaning pig according to claim 1 wherein said pig body is tapered to a reduced diameter portion at said forward end, and wherein said channels and said brush means extend into the tapered portion.

8. A cleaning pig according to claim 1 wherein said pig body rearward end is concave.

9. A cleaning pig according to claim 1 where there are N said channels in spaced apart spiral format, each channel covering a segment of the pig body external cylindrical surface through an arc of more than 360°/N whereby as the pig moves through a pipeline the entire internal cylindrical surface is contacted by said brush means.

10. A cleaning pig according to claim 1 wherein said semi-rigid material is polyurethane foam material.

11. A cleaning pig according to claim 1 wherein each said channel formed in said pig body cylindrical surface is in a spiral pattern.

* * * * *